US011114067B2

(12) United States Patent
Hong

(10) Patent No.: US 11,114,067 B2
(45) Date of Patent: Sep. 7, 2021

(54) DISPLAY DEVICE

(71) Applicant: LG ELECTRONICS INC., Seoul (KR)

(72) Inventor: Beduero Hong, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 16/810,749

(22) Filed: Mar. 5, 2020

(65) Prior Publication Data

US 2021/0110792 A1 Apr. 15, 2021

(30) Foreign Application Priority Data

Oct. 11, 2019 (WO) ..... PCT/KR2019/013360

(51) Int. Cl.

*G09G 5/373* (2006.01)
*G09G 5/38* (2006.01)
*G09F 9/30* (2006.01)

(52) U.S. Cl.

CPC ..... *G09G 5/373* (2013.01); *G09F 9/301* (2013.01); *G09G 2340/0442* (2013.01); *G09G 2380/02* (2013.01)

(58) Field of Classification Search

CPC ..... G09G 5/373; G09G 5/38; G09F 9/301
See application file for complete search history.

(56) References Cited

U.S. PATENT DOCUMENTS

| | | | |
|---|---|---|---|
| 10,304,417 | B2 | 5/2019 | Park et al. |
| 10,420,227 | B2 | 9/2019 | Lee et al. |
| 2016/0307545 | A1 | 10/2016 | Lee et al. |
| 2018/0342225 | A1 | 11/2018 | Yun |
| 2018/0376603 | A1 | 12/2018 | Lee et al. |
| 2019/0197960 | A1 | 6/2019 | Kim |

FOREIGN PATENT DOCUMENTS

| | | |
|---|---|---|
| KR | 10-2016-0123201 | 10/2016 |
| KR | 10-2018-0128261 | 12/2018 |
| KR | 10-2018-0134236 | 12/2018 |
| KR | 10-2019-0079241 | 7/2019 |

OTHER PUBLICATIONS

PCT International Application No. PCT/KR2019/013360, International Search Report dated Jul. 8, 2020, 3 pages.

*Primary Examiner* — Sardis F Azongha
(74) *Attorney, Agent, or Firm* — Lee, Hong, Degerman, Kang & Waimey

(57) ABSTRACT

Disclosed is a display device for maximizing the possibility that an after image is formed in a rollable display, including a housing, a guide bar accommodated in the housing and configured to rotate, a display configured to be drawn out from the housing along with rotation of the guide bar and to be retracted into the housing, and a controller configured to display the display content in a region of the display, which is drawn out from the housing, in which a draw-out length of the display that is partially drawn out from the housing is variable.

18 Claims, 14 Drawing Sheets

(a)

(b)

DISPLAY DEVICE

CROSS-REFERENCE TO RELATED APPLICATIONS

Pursuant to 35 U.S.C. § 119 (a), this application claims the benefit of an earlier filing date and right of priority to International Application No. PCT/KR2019/013360 filed on Oct. 11, 2019, the contents of which are hereby incorporated by reference herein in its entirety.

FIELD

The present disclosure relates to a display device, and more particularly, to a display device including a flexible display.

BACKGROUND

A display device has a function of receiving, processing, and displaying an image to be watched by a user. For example, the display device receives a broadcast signal selected by a user among broadcast signals transmitted from a broadcasting station, separates an image signal from the received signal, and re-displays the separated image signal on a display.

Recently, by virtue of development of broadcasting technology and network technology, a function of a display device has been significantly diversified and accordingly the performance of the device has also been enhanced. That is, the display device has developed to provide various different contents as well as simply broadcast content to a user. For example, the display device may provide gameplay, listening to music, Internet shopping, user customized information, or the like using various applications as well as programs received from a broadcasting station. In order to perform such extended functions, the display device is basically connected to other devices or networks using various communication programs and provides a ubiquitous computing environment to a user. That is, the display device has evolved to a smart device for achieving connectivity to a network and ubiquitous computing.

Recently, a flexible display that is capable of being deformed due to sufficient elasticity has developed. The flexible display is capable of being deformed to be rolled into a body of the display device.

The display device may include the above flexible display and may include a rollable display that is partially drawn out of the display by a different degree by winding or unwinding the rollable display in a direction guided by a guide bar. Due to use of the rollable display, the display device may have a relatively compact structure.

Thus, an entire display region may be drawn out to display content thereon, or a portion of the display region may be drawn out to display content thereon.

When content is continuously displayed only in a portion of the display region, there is a problem in that the possibility that an afterimage is formed at a boundary between a region in which content is displayed and a region in which content is not displayed is high.

SUMMARY

An object of the present disclosure is to provide a display device for minimizing the possibility that an after image is formed in a rollable display.

An object of the present disclosure is to provide a display device for minimizing the possibility that an after image is formed without reduction in brightness of an image.

An object of the present disclosure is to provide a display device for overcoming a problem in terms of an afterimage while minimizing an interruption when the user watches an image.

A display device according to an embodiment of the present disclosure comprises a housing, a display, a roller accommodated in the housing and configured to rotate to make the display be wound or unwound around the roller, and a controller configured to control the display to display content on a region of the display, which is drawn out from the housing, wherein a variable draw-out length of the display is variable in a partial view mode in which a portion of the display is drawn out from the housing.

The controller controls the roller so that the draw-out length of the display is changed whenever entering the partial view mode.

The controller controls the draw-out length of the display to a first length at a first time entering the partial view mode and controls the draw-out length of the display to a second length at a second time entering the partial view mode.

The controller controls the display to display content in a first region of the display that is drawn out by the first length at the first time and to display content in a second region of the display that is drawn by the second length at the second time.

The controller controls the roller so that the draw-out length of the display is changed when the partial view mode is maintained.

The controller controls the roller so that the display is drawn out by a second length when a time, during which the display is drawn out by the first length, elapses by a setting period.

The controller changes a region, in which the content is displayed, depending on the draw-out length of the display when the draw-out length of the display is changed.

The controller controls the display so that a layout of the content is changed when the draw-out length of the display is changed every setting period.

The controller controls the display so that a region, in which the content is displayed, is an entire draw-out region of the display whenever the draw-out length of the display is changed.

The controller controls the display so that a region, in which the content is displayed, is changed depending on the draw-out length when the draw-out length of the display is changed.

The controller controls the display in the partial view mode when receiving an operation command into a frame mode.

The controller controls the display in the frame mode to move an image set in a first direction, to re-display the image set, which disappears in the first direction, in a second direction, and to change a position of the image set when the image set is displayed in the second direction.

The controller controls the display to display a background of a region, in which an image is displayed, to be black in the frame mode.

The controller controls the display so that a region, in which the content is displayed, in a draw-out region of the display is changed when the partial view mode is maintained for a predetermined time or greater.

The controller controls the display so that a region, in which the content is displayed, is changed whenever entering the partial view mode.

The controller controls the roller so that the draw-out length of the display in the partial view mode is 20% to 35% of a draw-out length in a full view mode, in which the display is drawn out to the maximum from the housing.

The controller randomly determines the draw-out length of the display within a predetermined range when entering the partial view mode.

The controller controls the roller so that the draw-out length of the display when entering the partial view mode from a zero view mode in which the display is entirely retracted into the housing is different from the draw-out length of the display when entering the partial view mode from a full view mode in which the display is drawn out from the housing to the maximum.

The controller fixes a size of a region in which the content is displayed, irrespective of the draw-out length of the display.

The controller moves the region in which the content is displayed within the region where the display is drawn out from the housing.

DETAILED DESCRIPTION

Hereinafter, embodiments relating to the present disclosure will be described in detail with reference to the accompanying drawings. The suffixes "module" and "unit" for components used in the description below are assigned or mixed in consideration of easiness in writing the specification and do not have distinctive meanings or roles by themselves. In addition, in describing the embodiments disclosed herein, when it is determined that the detailed description of the related known technology may obscure the gist of the embodiments disclosed herein, the detailed description thereof will be omitted. The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

It will be understood that although the terms first, second, etc. may be used herein to describe various elements, these elements should not be limited by these terms. These terms are generally only used to distinguish one element from another.

It will be understood that when an element is referred to as being "connected with" another element, the element may be connected with the other element or intervening elements may also be present. In contrast, when an element is referred to as being "directly connected with" another element, there are no intervening elements present.

A singular representation may include a plural representation unless it represents a definitely different meaning from the context.

Terms such as "include" or "has" are used herein and should be understood that they are intended to indicate an existence of several components, functions or steps, disclosed in the specification, and it is also understood that greater or fewer components, functions, or steps may likewise be utilized.

The display device described in this specification refers to a TV, a smart TV, a network TV, a hybrid broadcast broadband television (HBBTV), an Internet TV, a web TV, an Internet protocol television (IPTV), digital signage, a desktop computer, a smartphone, a laptop computer, a digital broadcast terminal, a personal digital assistant (PDA), a portable multimedia player (PMP), a navigation system, a slate PC, a tablet PC, an ultrabook, a wearable device, etc. including a rollable display. Here, rollable display means that a display may be rolled in the form of a roll and may include a flexible display, a foldable display, etc.

Figure 1:
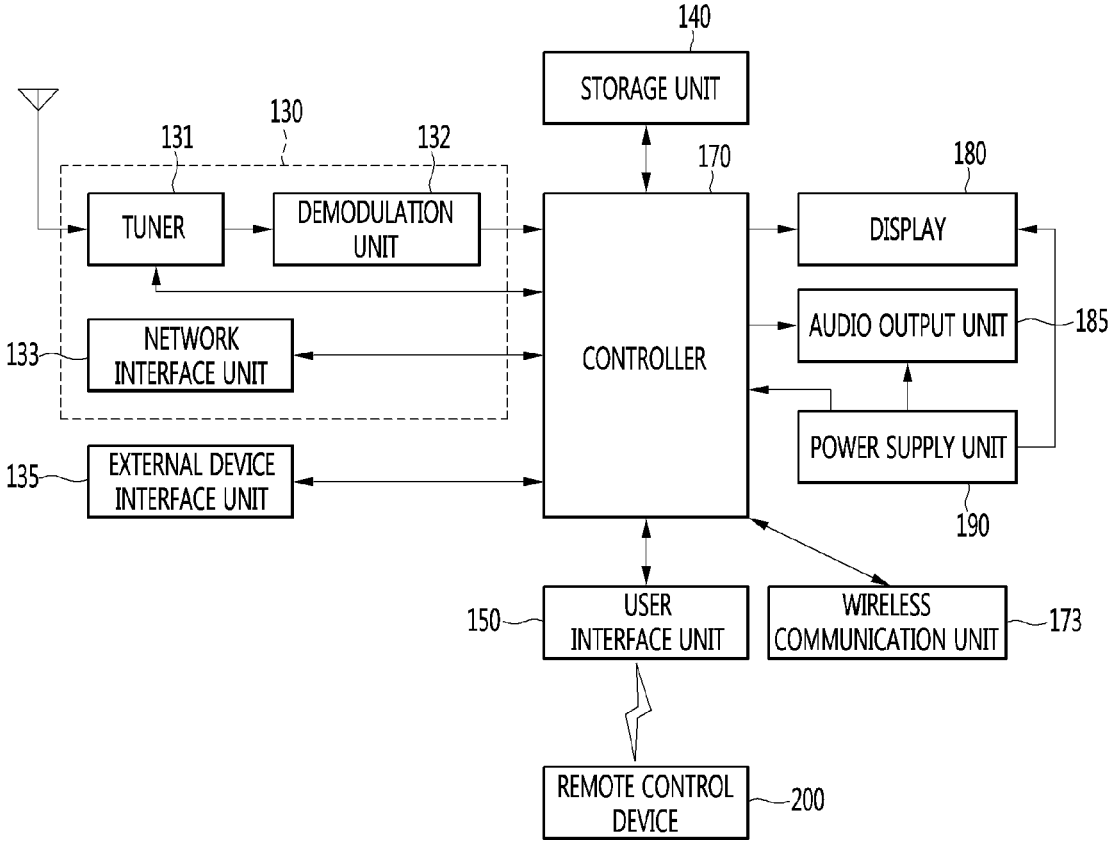
FIG. 1 is a block diagram illustrating a configuration of a display device according to an embodiment of the present disclosure.

FIG. 1 is a block diagram illustrating a configuration of a display device according to an embodiment of the present disclosure.

Referring to FIG. 1, a display device 100 may include a broadcast reception unit 130, an external device interface unit 135, a storage unit 140, a user input interface unit 150, a controller 170, a wireless communication unit 173, a display 180, an audio output unit 185, and a power supply unit 190.

The broadcast reception unit 130 may include a tuner 131, a demodulation unit 132, and a network interface unit 133.

The tuner 131 may select a specific broadcast channel according to a channel selection command. The tuner 131 may receive broadcast signals for the selected specific broadcast channel.

The demodulation unit 132 may divide the received broadcast signals into video signals, audio signals, and broadcast program related data signals and restore the divided video signals, audio signals, and data signals to an output available form.

The network interface unit 133 may provide an interface for connecting the display device 100 to a wired/wireless network including internet network. The network interface unit 133 may transmit or receive data to or from another user or another electronic device through an accessed network or another network linked to the accessed network.

The network interface unit 133 may transmit or receive data to or from another user or another electronic device through an accessed network or another network linked to the accessed network.

The network interface unit 133 may access a predetermined webpage through an accessed network or another network linked to the accessed network. That is, it may transmit or receive data to or from a corresponding server by accessing a predetermined webpage through network.

Then, the network interface unit 133 may receive contents or data provided from a content provider or a network operator. That is, the network interface unit 133 may receive contents such as movies, advertisements, games, VODs, and broadcast signals, which are provided from a content provider or a network provider, through network and information relating thereto.

Additionally, the network interface unit 133 may receive firmware update information and update files provided from a network operator and transmit data to an internet or content provider or a network operator.

The network interface unit 133 may select and receive a desired application among applications open to the air, through network.

The external device interface unit 135 may receive an application or an application list in an adjacent external device and deliver it to the controller 170 or the storage unit 140.

The external device interface 135 may provide a connection path between the display device 100 and an external device. The external device interface 135 may receive at least one of image and audio outputted from an external device that is wirelessly connected or connected via a wired to the display device 100 and deliver it to the controller. The external device interface unit 135 may include a plurality of external input terminals. The plurality of external input terminals may include an RGB terminal, at least one High Definition Multimedia Interface (HDMI) terminal, and a component terminal.

The storage unit 140 may store signal-processed image, voice, or data signals stored by a program in order for each signal processing and control in the controller 170.

Additionally, the storage unit 140 may perform a function for temporarily store image, voice, or data signals output from the external device interface unit 135 or the network interface unit 133 and may store information on a predetermined image through a channel memory function.

The storage unit 140 may store an application or an application list inputted from the external device interface unit 135 or the network interface unit 133.

The display device 100 may play content files (for example, video files, still image files, music files, document files, application files, and so on) stored in the storage unit 140 and provide them to a user.

The user input interface unit 150 may deliver signals inputted from a user to the controller 170 or deliver signals from the controller 170 to a user. For example, the user input interface unit 150 may receive or process control signals such as power on/off, channel selection, and screen setting from the remote control device 200 or transmit control signals from the controller 170 to the remote control device 200 according to various communication methods such as Bluetooth, Ultra Wideband (WB), ZigBee, Radio Frequency (RF), and IR.

Additionally, the user input interface unit 150 may deliver, to the controller 170, control signals inputted from local keys (not shown) such as a power key, a channel key, a volume key, and a setting key.

Image signals that are image-processed in the controller 170 may be inputted to the display 180 and displayed as an image corresponding to corresponding image signals. Additionally, image signals that are image-processed in the controller 170 may be inputted to an external output device through the external device interface unit 135.

Voice signals processed in the controller 170 may be output to the audio output unit 185. Additionally, voice signals processed in the controller 170 may be inputted to an external output device through the external device interface unit 135.

Besides that, the control module 170 may control overall operations in the display device 100.

Additionally, the controller 170 may control the display device 100 by a user command or internal program inputted through the user input interface unit 150 and download a desired application or application list into the display device 100 in access to network.

The controller 170 may output channel information selected by a user together with processed image or voice signals through the display 180 or the audio output unit 185.

Additionally, according to an external device image playback command received through the user input interface unit 150, the controller 170 may output image signals or voice signals of an external device such as a camera or a camcorder, which are inputted through the external device interface unit 135, through the display 180 or the audio output unit 185.

Moreover, the controller 170 may control the display 180 to display images and control broadcast images inputted through the tuner 131, external input images inputted through the external device interface unit 135, images inputted through the network interface unit, or images stored in the storage unit 140 to be displayed on the display 180. In this case, an image displayed on the display 180 may be a still image or video and also may be a 2D image or a 3D image.

Additionally, the controller 170 may play content stored in the display device 100, received broadcast content, and external input content inputted from the outside, and the content may be in various formats such as broadcast images, external input images, audio files, still images, accessed web screens, and document files.

Moreover, the wireless communication unit 173 may perform a wired or wireless communication with an external electronic device. The wireless communication unit 173 may perform short-range communication with an external device. For this, the wireless communication unit 173 may support short-range communication by using at least one of Bluetooth™, Radio Frequency Identification (RFID), Infrared Data Association (IrDA), Ultra Wideband (UWB), ZigBee, Near Field Communication (NFC), Wireless-Fidelity (Wi-Fi), Wi-Fi Direct, and Wireless Universal Serial Bus (USB) technologies. The wireless communication unit 173 may support wireless communication between the display device 100 and a wireless communication system, between the display device 100 and another display device 100, or between networks including the display device 100 and another display device 100 (or an external server) through wireless area networks. The wireless area networks may be wireless personal area networks.

Herein, the other display device 100 may be a mobile terminal such as a wearable device (for example, a smart watch, a smart glass, and a head mounted display (HMD)) or a smartphone, which is capable of exchanging data (or inter-working) with the display device 100. The wireless communication unit 173 may detect (or recognize) a communicable wearable device around the display device 100. Furthermore, if the detected wearable device is a device authenticated to communicate with the display device 100, the controller 170 may transmit at least part of data processed in the display device 100 to the wearable device through the wireless communication unit 173. Accordingly, a user of the wearable device may use the data processed in the display device 100 through the wearable device.

The display 180 may convert image signals, data signals, or OSD signals, which are processed in the controller 170, or images signals or data signals, which are received in the external device interface unit 135, into R, G, and B signals to generate driving signals.

The display 180 may include a rollable display.

Figure 7:
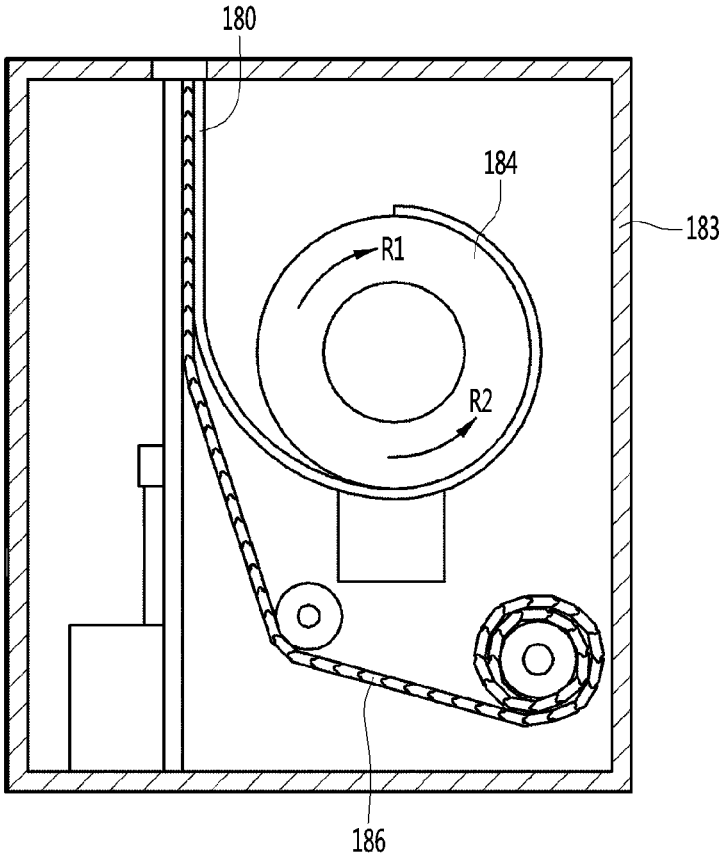
FIG. 7 is a cross-sectional view illustrating an internal part of a housing of a display device according to the present disclosure.

The rollable display may refer to a display that is retracted into a housing 183 (refer to FIG. 7) and is wound around a guide bar 184 (refer to FIG. 7) or is drawn out from the housing 183 (refer to FIG. 7) and is unwound from the guide bar 184 (refer to FIG. 7).

The display device 100 may include the rollable display. A region, in which content is displayed, may increase or decrease according to withdrawal or insertion of the rollable display.

The below-described display 180 may include the rollable display.

Furthermore, the display device 100 shown in FIG. 1 is just one embodiment of the present disclosure and thus, some of the components shown may be integrated, added, or omitted according to the specification of the actually implemented display device 100.

That is, if necessary, two or more components may be integrated into one component or one component may be divided into two or more components and configured. Additionally, a function performed by each block is to describe an embodiment of the present disclosure and its specific operation or device does not limit the scope of the present disclosure.

According to another embodiment of the present disclosure, unlike FIG. 1, the display device 100 may receive images through the network interface unit 133 or the external device interface unit 135 and play them without including the tuner 131 and the demodulation unit 132.

For example, the display device 100 may be divided into an image processing device such as a set-top box for receiving broadcast signals or contents according to various network services and a content playback device for playing contents inputted from the image processing device.

In this case, an operating method of a display device according to an embodiment of the present disclosure described below may be performed by one of the display device described with reference to FIG. 1, an image processing device such as the separated set-top box, and a content playback device including the display 180 and the audio output unit 185.

Figure 2:
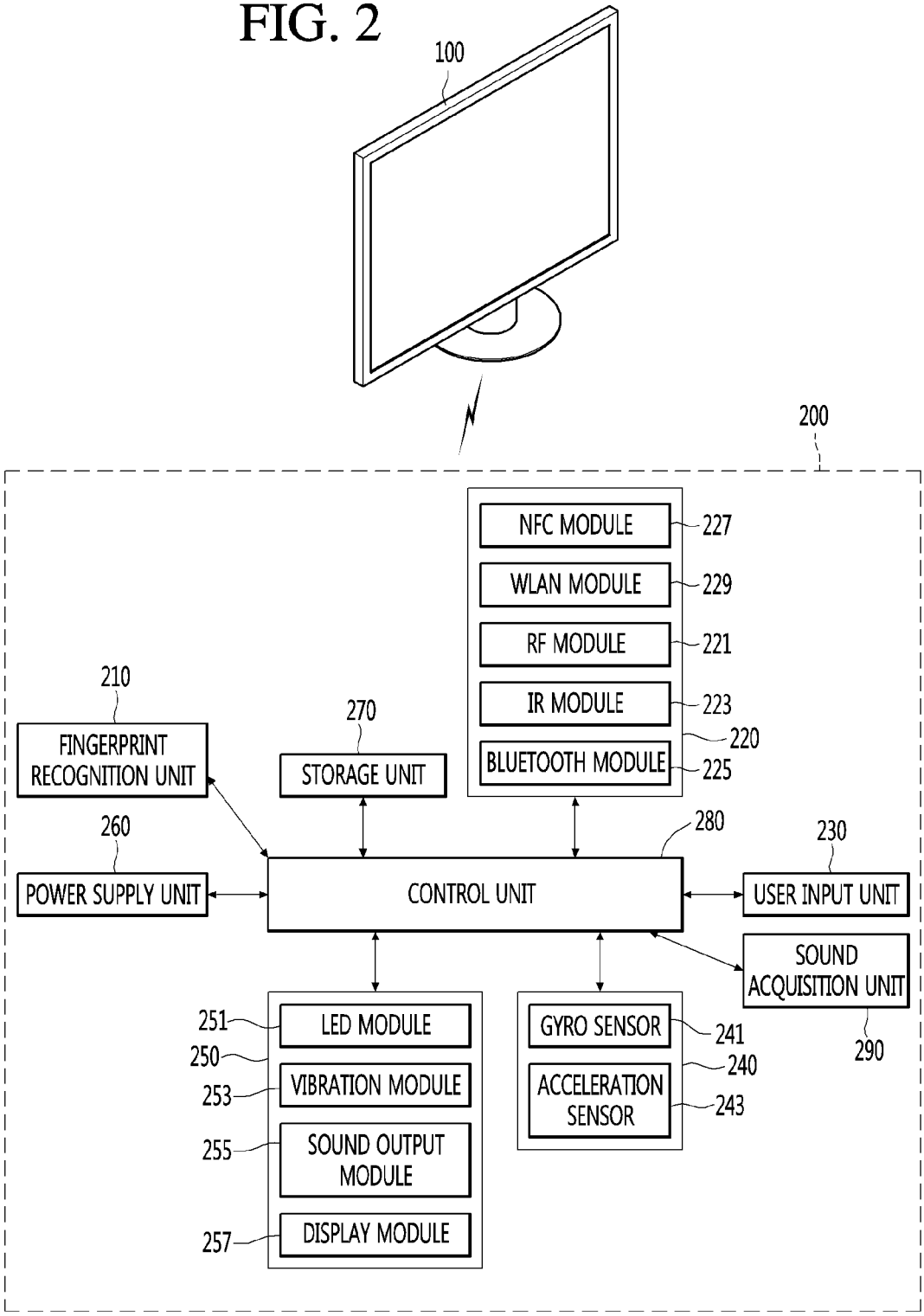
FIG. 2 is a block diagram illustrating a remote control device according to an embodiment of the present disclosure.
Figure 3:
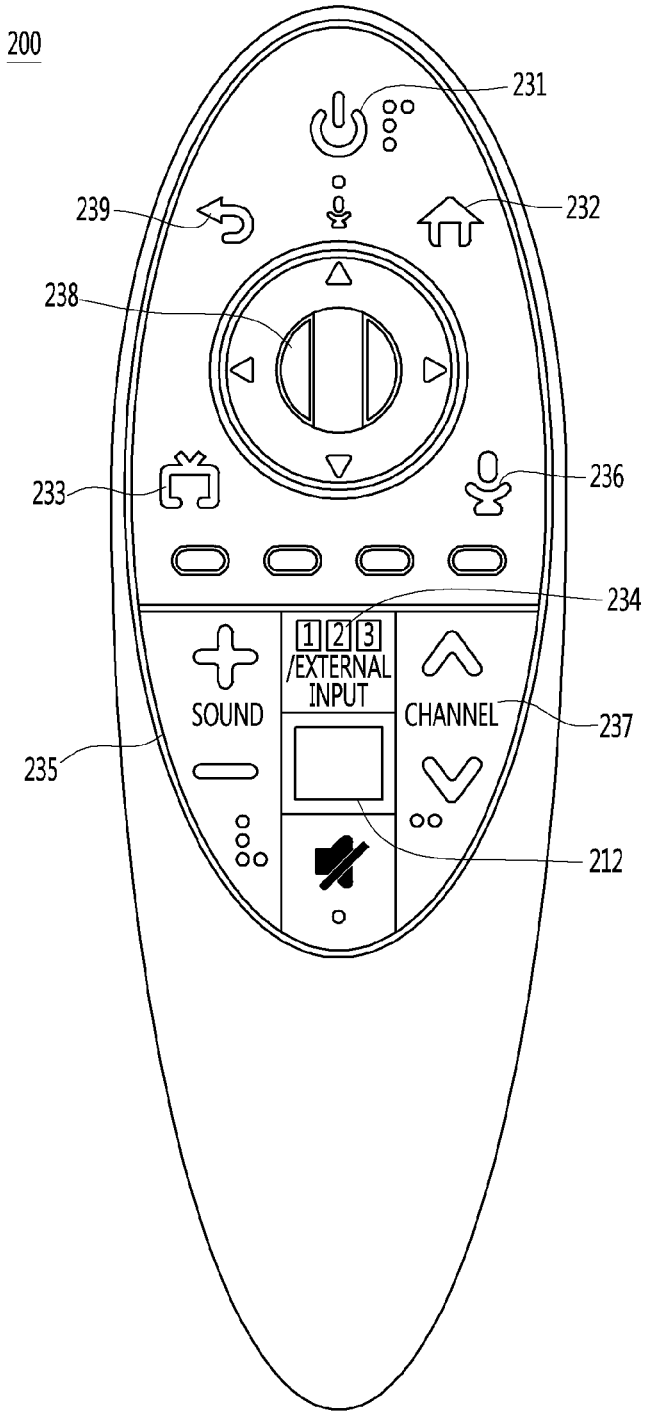
FIG. 3 is a view illustrating an actual configuration of a remote control device according to an embodiment of the present disclosure.

Then, referring to FIGS. 2 and 3, a remote control device is described according to an embodiment of the present disclosure.

FIG. 2 is a block diagram illustrating a remote control device according to an embodiment of the present disclosure and FIG. 3 is a view illustrating an actual configuration of a remote control device according to an embodiment of the present disclosure.

First, referring to FIG. 2, a remote control device 200 may include a fingerprint recognition unit 210, a wireless communication unit 220, a user input unit 230, a sensor unit 240, an output unit 250, a power supply unit 260, a storage unit 270, a controller 280, and a voice acquisition unit 290.

Referring to FIG. 2, the wireless communication unit 225 transmits/receives signals to/from an arbitrary any one of display devices according to the above-mentioned embodiments of the present disclosure.

The remote control device 200 may include an RF module 221 for transmitting/receiving signals to/from the display device 100 according to the RF communication standards and an IR module 223 for transmitting/receiving signals to/from the display device 100 according to the IR communication standards. Additionally, the remote control device 200 may include a Bluetooth module 225 for transmitting/receiving signals to/from the display device 100 according to the Bluetooth communication standards. Additionally, the remote control device 200 may include an NFC module 227 for transmitting/receiving signals to/from the display device 100 according to the Near Field Communication (NFC) communication standards and a WLAN module 229 for transmitting/receiving signals to/from the display device 100 according to the Wireless LAN (WLAN) communication standards Additionally, the remote control device 200 may transmit signals containing information on a movement of the remote control device 200 to the display device 100 through the wireless communication unit 220.

Moreover, the remote control device 200 may receive signals transmitted from the display device 100 through the RF module 221 and if necessary, may transmit a command on power on/off, channel change, and volume change to the display device 100 through the IR module 223.

The user input unit 230 may be configured with a keypad button, a touch pad, or a touch screen. A user may manipulate the user input unit 230 to input a command relating to the display device 100 to the remote control device 200. If the user input unit 230 includes a hard key button, a user may input a command relating to the display device 100 to the remote control device 200 through the push operation of the hard key button. This will be described with reference to FIG. 3.

Referring to FIG. 3, the remote control device 200 may include a plurality of buttons. The plurality of buttons may include a fingerprint recognition button 212, a power button 231, a home button 232, a live button 233, an external input button 234, a voice adjustment button 235, a voice recognition button 236, a channel change button 237, a check button 238, and a back button 239.

The fingerprint recognition button 212 may be a button for recognizing a user's fingerprint. According to an embodiment of the present disclosure, the fingerprint recognition button 212 may perform a push operation and receive a push operation and a fingerprint recognition operation. The power button 231 may be button for turning on/off the power of the display device 100. The power button 232 may be button for moving to the home screen of the display device 100. The live button 233 may be a button for displaying live broadcast programs. The external input button 234 may be button for receiving an external input connected to the display device 100. The voice adjustment button 235 may be button for adjusting the size of a volume output from the display device 100. The voice recognition button 236 may be a button for receiving user's voice and recognizing the received voice. The channel change button 237 may be a button for receiving broadcast signals of a specific broadcast channel. The check button 238 may be a button for selecting a specific function and the back button 239 may be a button for returning to a previous screen.

Again, FIG. 2 is described.

If the user input unit 230 includes a touch screen, a user may touch a soft key of the touch screen to input a command relating to the display device 100 to the remote control device 200. Additionally, the user input unit 230 may include various kinds of input means manipulated by a user, for example, a scroll key and a jog key, and this embodiment does not limit the scope of the present disclosure.

The sensor unit 240 may include a gyro sensor 241 or an acceleration sensor 243 and the gyro sensor 241 may sense information on a movement of the remote control device 200.

For example, the gyro sensor 241 may sense information on an operation of the remote control device 200 on the basis of x, y, and z axes and the acceleration sensor 243 may sense information on a movement speed of the remote control device 200. Moreover, the remote control device 200 may further include a distance measurement sensor and sense a distance with respect to the display 180 of the display device 100.

The output unit 250 may output image or voice signals corresponding to a manipulation of the user input unit 235 or corresponding to signals transmitted from the display device 100. A user may recognize whether the user input unit 235 is manipulated or the display device 100 is controlled through the output unit 250.

For example, the output unit 250 may include an LED module 251 for flashing, a vibration module 253 for generating vibration, a sound output module 255 for outputting sound, or a display module 257 for outputting an image, if the user input unit 235 is manipulated or signals are transmitted/received to/from the display device 100 through the wireless communication unit 225.

Additionally, the power supply unit 260 supplies power to the remote control device 200 and if the remote control device 200 does not move for a predetermined time, stops the power supply, so that power waste may be reduced. The power supply unit 260 may resume the power supply if a predetermined key provided at the remote control device 200 is manipulated.

The storage unit 270 may store various kinds of programs and application data necessary for a control or operation of the remote control device 200. If the remote control device 200 transmits/receives signals wirelessly through the display device 100 and the RF module 221, the remote control device 200 and the display device 100 transmits/receives signals through a predetermined frequency band.

The controller 280 of the remote control device 200 may store, in the storage unit 270, information on a frequency band for transmitting/receiving signals to/from the display device 100 paired with the remote control device 200 and refer to it.

The controller 280 controls general matters relating to a control of the remote control device 200. The controller 280 may transmit a signal corresponding to a predetermined key manipulation of the user input unit 235 or a signal corresponding to a movement of the remote control device 200 sensed by the sensor unit 240 to the display device 100 through the wireless communication unit 225.

Additionally, the voice acquisition unit 290 of the remote control device 200 may obtain voice.

The voice acquisition unit 290 may include at least one microphone 291 and obtain voice through the microphone 291.

Figure 4:
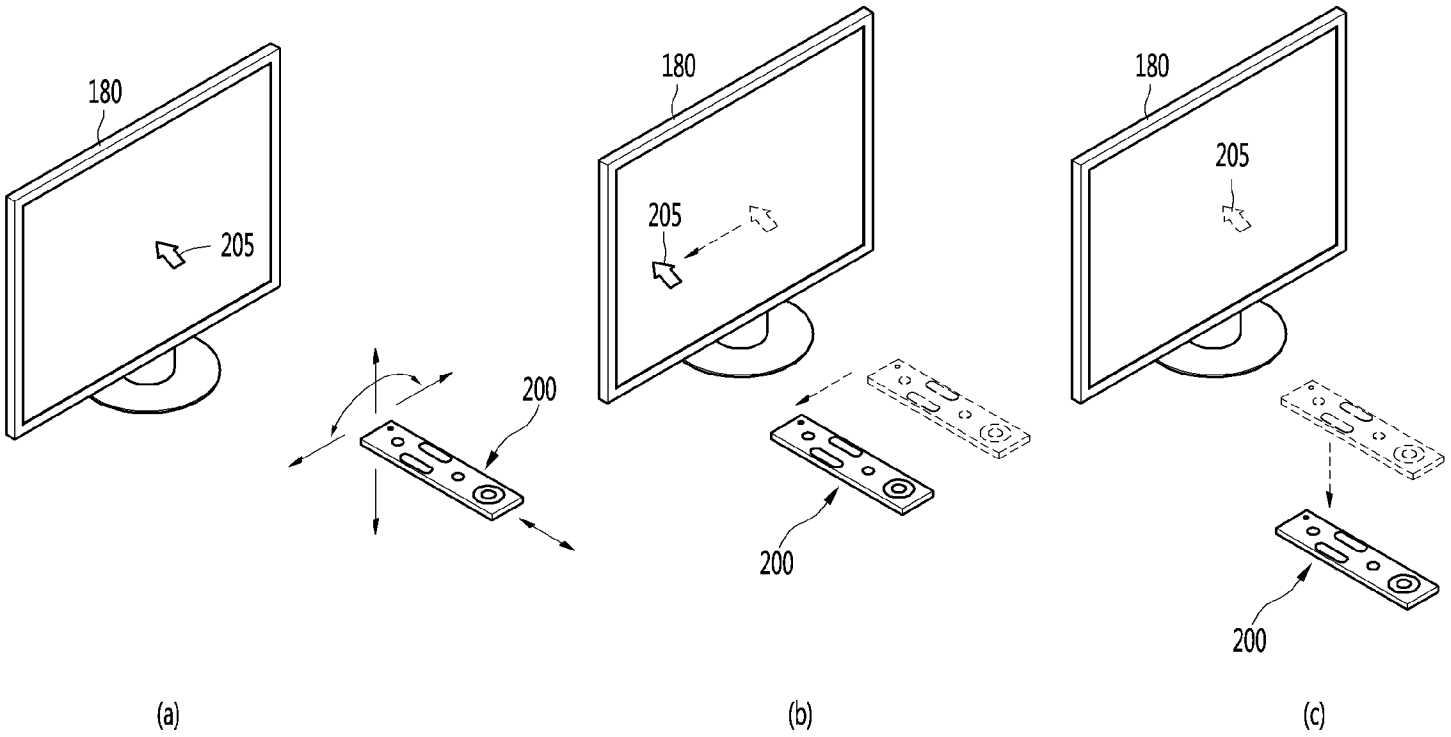
FIG. 4 is a view of utilizing a remote control device according to an embodiment of the present disclosure.

Then, FIG. 4 is described.

FIG. 4 is a view of utilizing a remote control device according to an embodiment of the present disclosure.

FIG. 4A illustrates that a pointer 205 corresponding to the remote control device 200 is displayed on the display 180.

A user may move or rotate the remote control device 200 vertically or horizontally. The pointer 205 displayed on the display 180 of the display device 100 corresponds to a movement of the remote control device 200. Since the corresponding pointer 205 is moved and displayed according to a movement on a 3D space as show in the drawing, the remote control device 200 may be referred to as a spatial remote controller.

FIG. 4B illustrates that if a user moves the remote control device 200, the pointer 205 displayed on the display 180 of the display device 100 is moved to the left in correspondence thereto.

Information on a movement of the remote control device 200 detected through a sensor of the remote control device 200 is transmitted to the display device 100. The display device 100 may calculate the coordinates of the pointer 205 from the information on the movement of the remote control device 200. The display device 100 may display the pointer 205 to match the calculated coordinates.

FIG. 4C illustrates that while a specific button in the remote control device 200 is pressed, a user moves the remote control device 200 away from the display 180. Thus, a selection area in the display 180 corresponding to the pointer 205 may be zoomed in and displayed largely.

On the other hand, if a user moves the remote control device 200 close to the display 180, a selection area in the display 180 corresponding to the pointer 205 may be zoomed out and displayed reduced.

On the other hand, if the remote control device 200 is away from the display 180, a selection area may be zoomed out and if the remote control device 200 is close to the display 180, a selection area may be zoomed in.

Additionally, if a specific button in the remote control device 200 is pressed, the recognition of a vertical or horizontal movement may be excluded. That is, if the remote control device 200 is moved away from or close to the display 180, the up, down, left, or right movement may not be recognized and only the back and forth movement may be recognized. While a specific button in the remote control device 200 is not pressed, only the pointer 205 is moved according to the up, down, left or right movement of the remote control device 200.

Moreover, the moving speed or moving direction of the pointer 205 may correspond to the moving speed or moving direction of the remote control device 200.

Furthermore, a pointer in this specification means an object displayed on the display 180 in correspondence to an operation of the remote control device 200. Accordingly, besides an arrow form displayed as the pointer 205 in the drawing, various forms of objects are possible. For example, the above concept includes a point, a cursor, a prompt, and a thick outline. Then, the pointer 205 may be displayed in correspondence to one point of a horizontal axis and a vertical axis on the display 180 and also may be displayed in correspondence to a plurality of points such as a line and a surface.

Figure 5:
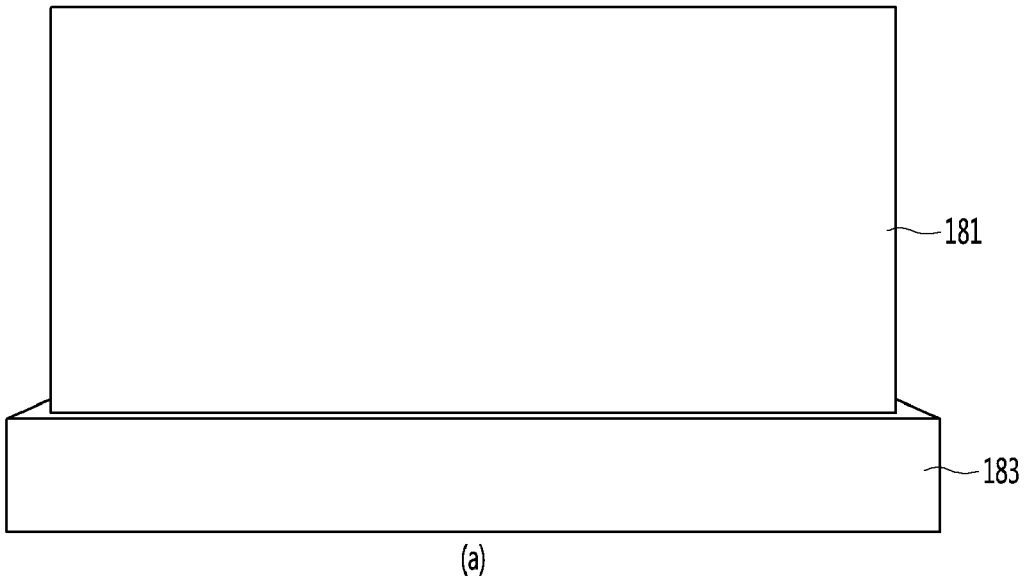
FIGS. 5 and 6 are views illustrating an operation of a display of a display device according to various embodiments of the present disclosure.
Figure 5:
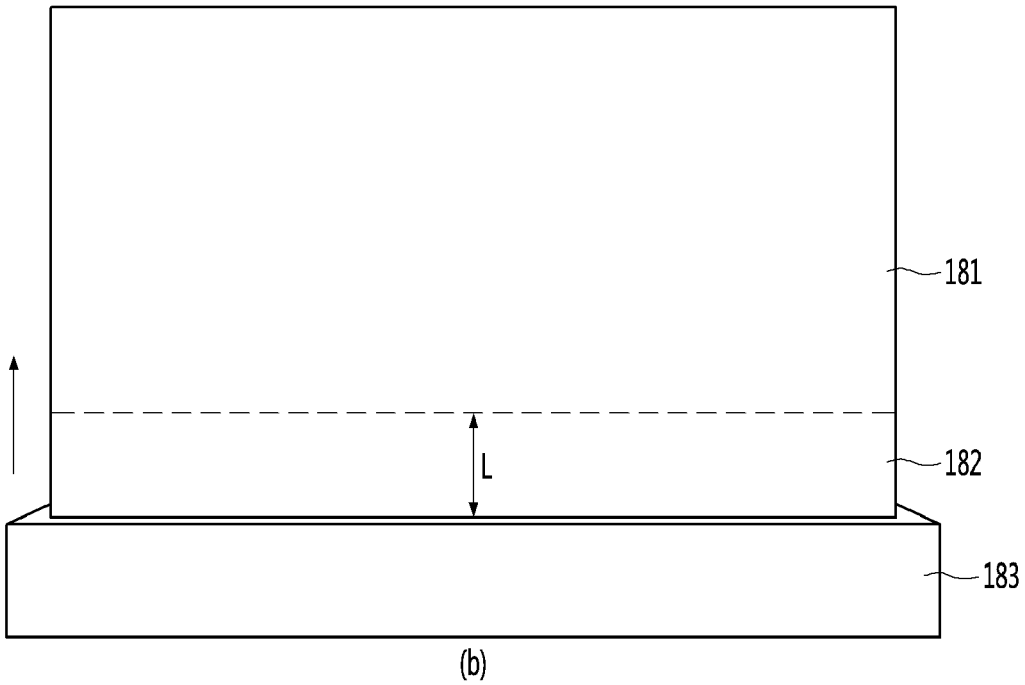
Figure 6:
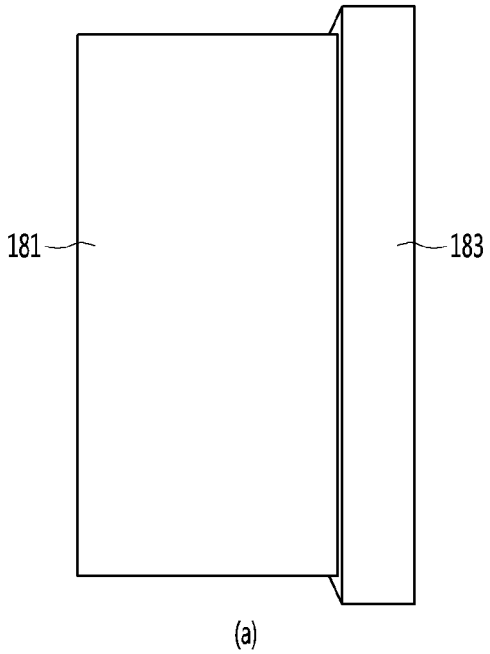
Figure 6:
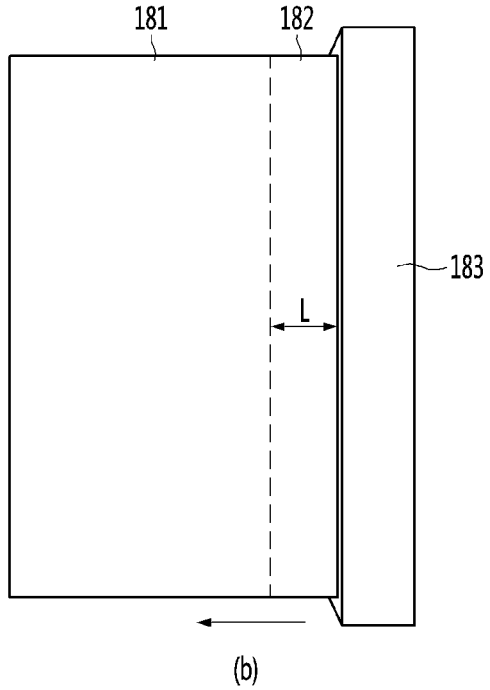

Then, FIGS. 5 and 6 are views illustrating an operation of a display of a display device according to various embodiments of the present disclosure.

According to an embodiment, the display device 100 may include the housing 183 and the display 180 that is drawn from the housing 183 or is retracted thereinto, and a shown in FIG. 5, the housing 183 may be installed to be accommodated on the bottom.

In this case, the display 180 may be lengthened in an upward direction when being drawn out from the housing 183. For example, as shown in FIG. 5A, when the display 180 is drawn out, content may be displayed on a first region 181 that is a draw-out region of the display 180. As shown in FIG. 5B, when the display 180 is additionally drawn out from the housing 183 in such a way that the draw-out region of the display 180 further includes a second region 182, content may be displayed in the first region 181 and the second region 182. A length L by which the display 180 is additionally drawn may be variable.

According to another embodiment, the display device 100 may include the housing 183 and the display 180 that is drawn out from the housing 183 or is retracted thereinto, and as shown in FIG. 6, the housing 183 may be installed to be fixed to a wall or the like.

In this case, the display 180 may be lengthened in a left or right direction when is drawn out from the housing 183. For example, as shown in FIG. 6A, when the display 180 is drawn out, content may be displayed in the first region 181 that is the draw-out region of the display 180. As shown in FIG. 6B, when the display 180 is additionally drawn out from the housing 183 in such a way that the draw-out region of the display 180 further includes the second region 182, content may be displayed in the first region 181 and the second region 182. The length L by which the display 180 is additionally drawn out may be variable.

The display device 100 may be installed in various forms without being limited to the example shown in FIGS. 5 and 6. For example, the display device 100 may also be installed in the form in which the housing 183 is fixed to a ceiling.

FIG. 7 is a cross-sectional view illustrating an internal part of a housing of a display device according to the present disclosure.

The display device 100 may include the housing 183, the display 180 that is drawn out from the housing 183 or is retracted thereinto, and the guide bar 184 configured to guide the display 180 to be wound or unwound.

The guide bar 184 may be accommodated in the housing 183.

The guide bar 184 may be a rotatable roller.

The guide bar 184 may be rotatable to wind or unwind the display 180. For example, as shown in FIG. 7, when the guide bar 184 is rotated in direction R1, the display 180 may be drawn out from the housing 183. In contrast, when the guide bar 184 is rotated in direction R2, the display 180 may be retracted into the housing 183 while being wound around the guide bar 184. As such, the display 180 may be drawn out or may be retracted up and down (in the case of FIG. 5) or right and left (in the case of FIG. 6).

The display 180 may be drawn out from the housing 183 or may be retracted into the housing 183 according to rotation of the guide bar 184.

The controller 170 may control the display 180 to display content in a region of the display 180, which is drawn out from the housing 183.

In some embodiments, the display device 100 may further include a cover 186. The cover 186 may be disposed inside the housing 183 and may protect the display 180 that is retracted into the housing 183.

As such, as the display 180 is drawn out or is retracted, a region in which content is displayed may be increased or reduced. That is, as the display 180 is drawn out or is retracted, the region of the display 180 in which content is displayed may be variable.

Figure 8:
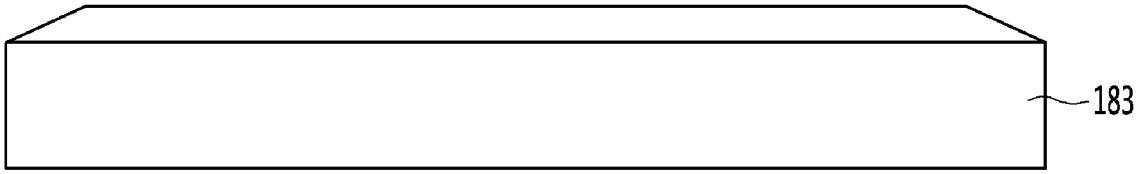
FIG. 8 is a view illustrating an example of the case in which a display is in a zero view mode according to an embodiment of the present disclosure.
Figure 9:
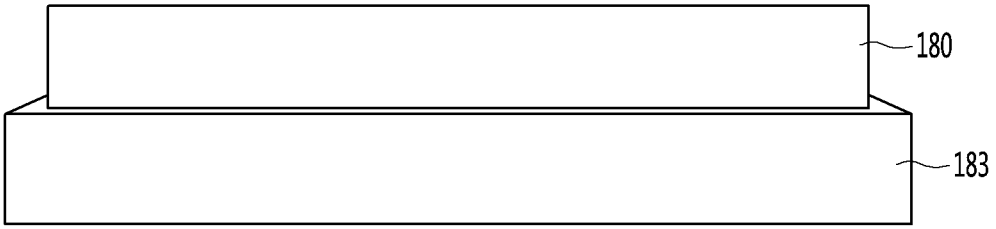
FIG. 9 is a view illustrating an example of the case in which a display is in a partial view mode according to an embodiment of the present disclosure.
Figure 10:
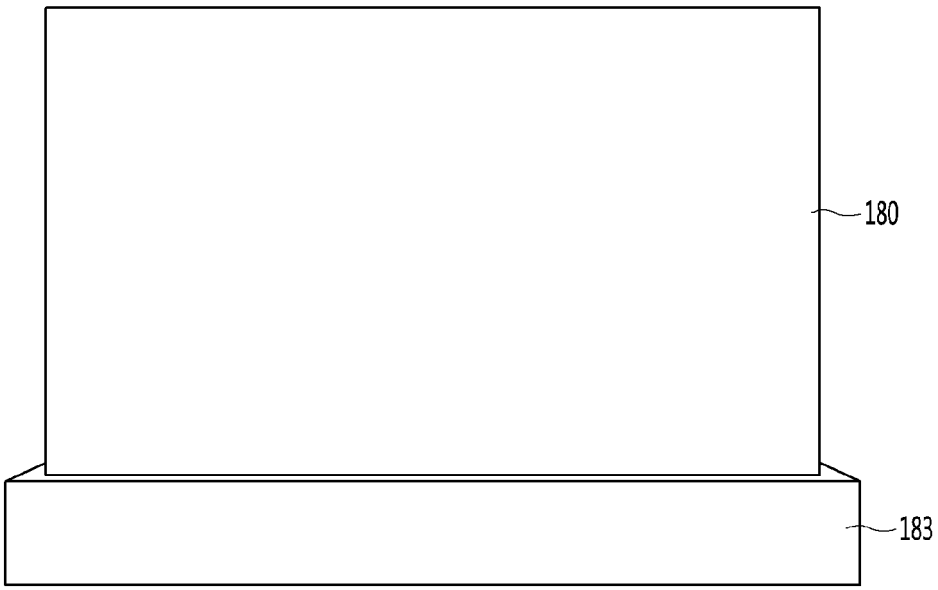
FIG. 10 is a view illustrating an example of the case in which a display is in a full view mode according to an embodiment of the present disclosure.

Then, with reference to FIGS. 8 to 10, a draw-out length of the display 180 according to an operation mode of the display device 100 is described.

FIG. 8 is a view illustrating an example of the case in which a display is in a zero view mode according to an embodiment of the present disclosure. FIG. 9 is a view illustrating an example of the case in which a display is in a partial view mode according to an embodiment of the present disclosure. FIG. 10 is a view illustrating an example of the case in which a display is in a full view mode according to an embodiment of the present disclosure.

The terms, e.g., 'zero view mode', 'partial view mode', and 'full view mode' used in the present disclosure are merely exemplary, and thus may not be limited.

The zero view mode may be an operation mode in which an entire portion of the display 180 is retracted into the housing 183. For example, when the display device 100 is operated in a speaker mode, the display 180 may be controlled in the zero view mode.

When the display 180 is in the zero view mode, content may not be displayed in an entire region of the display 180. The display 180 may be turned off in the zero view mode.

The partial view mode may be an operation mode in which a portion of the display 180 is drawn out from the housing 183. For example, when the display device 100 is operated in a menu mode, a mood mode, a music mode, a frame mode, a clock mode, or the like, the display 180 may be controlled in the partial view mode.

When the display 180 is in the partial view mode, content may be displayed only in a region of the display 180, which is drawn out from the housing 183. That is, in the partial view mode, content may not be displayed in a region of the display 180, which is retracted into the housing 183.

The full view mode may be an operation mode in which the display 180 is drawn out from the housing 183 to the maximum. That is, the full view mode may be a mode in which the draw-out length of the display 180 from the housing 183 is a maximum length. For example, when the display device 100 is operated in a normal mode, the display 180 may be controlled in the full view mode, and in this case, the normal mode may be a mode in which a broadcast image, an input image from the user input interface unit 150, or the like is output.

When the display 180 is in the full view mode, content may be displayed in a region of the display 180, which is drawn out from the housing 183. In the full view mode, the display 180 may display content in an entire region of the display 180, from which content is capable of being output.

As described with reference to FIGS. 8 to 10, the display region of content may be changed depending on the draw-out length of the display 180.

When the display 180 is continuously operated in the full view mode, only a partial region of the display 180 is degraded, and thus an afterimage may be formed at a boundary between the region that is degraded and a region that is not degraded.

Figure 11:
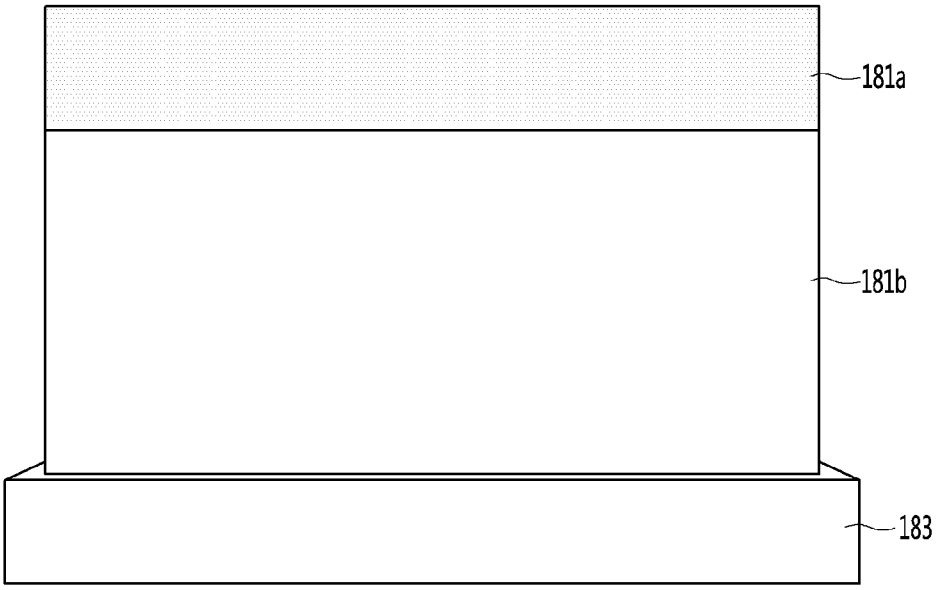
FIG. 11 is a view illustrating an example of a problem in terms of an afterimage formed in a display according to an embodiment of the present disclosure.

FIG. 11 is a view illustrating an example of a problem in terms of an afterimage formed in a display according to an embodiment of the present disclosure.

When the display 180 is in the zero view mode, content may not be displayed in an entire region of the display 180, and thus degradation is not problematic.

However, when the display 180 is in the partial view mode, content may be displayed only in a partial region of the display 180 (hereinafter referred to as a 'partial view mode draw-out region' for convenience of description), which is drawn out from the housing 183, and thus a partial view mode draw-out region 181*a* may be rapidly degraded. In contrast, content may be displayed in a partial view mode non-draw-out region 181*b* obtained by excluding the partial view mode draw-out region 181*a* from the display 180 only in the full view mode, and thus a speed at which the partial view mode non-draw-out region 181*b* is degraded may be lower than a speed at which the partial view mode draw-out region 181*a* is degraded. In this case, the possibility that an afterimage is formed at a boundary between the partial view mode draw-out region 181*a* and the partial view mode non-draw-out region 181*b* may be high.

In detail, when the partial view mode draw-out region 181*a* is degraded and the partial view mode non-draw-out region 181*b* is not degraded, a region that is degraded and a region that is not degraded may be obviously different, and thus an afterimage may be formed at a boundary between the partial view mode draw-out region 181*a* and the partial view mode non-draw-out region 181*b*.

In particular, when the display device 100 is operated in the frame mode, the same image may be continuously displayed in the partial view mode draw-out region 181*a*, and thus the problem in terms of an afterimage may become more serious.

According to an embodiment of the present disclosure, in order to overcome the above problem in terms of an afterimage, the display device 100 may adjust at least one of a display region in the partial view mode draw-out region 181*a*, in which content is displayed, a method of displaying content in the partial view mode draw-out region 181*a*, or the partial view mode draw-out region 181*a*, and thus an afterimage may be less formed at the boundary between the partial view mode draw-out region 181*a* and the partial view mode non-draw-out region 181*b*.

Figure 12:
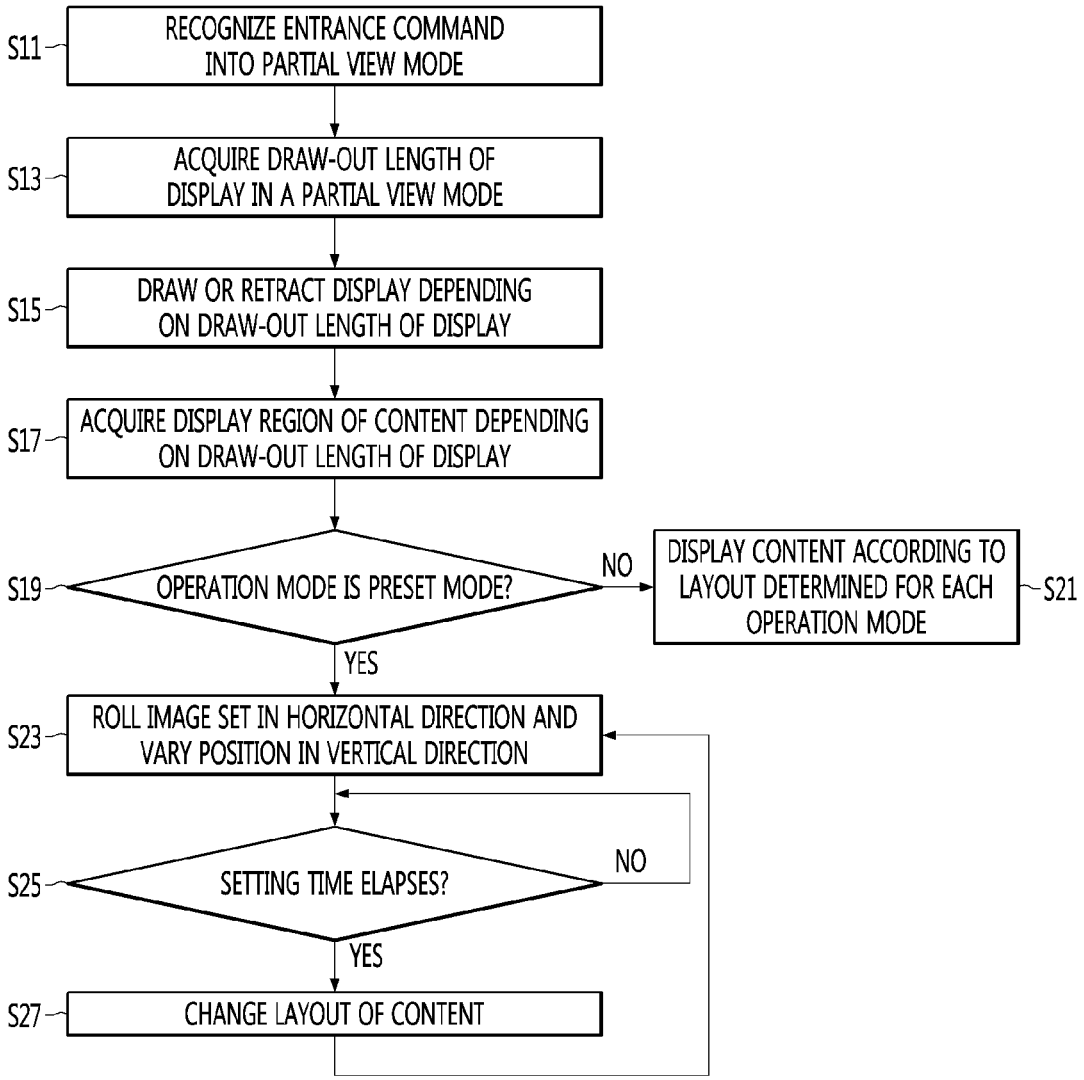
FIG. 12 is a flowchart illustrating an operation method of a display device according to an embodiment of the present disclosure.

FIG. 12 is a flowchart illustrating an operation method of a display device according to an embodiment of the present disclosure.

The controller 170 may recognize an entrance command into a partial view mode (S11).

When converting an operation mode of the display device 100 into a menu mode, a mood mode, a music mode, a frame mode, a clock mode, or the like, the controller 170 may recognize the entrance command into the partial view mode.

For example, when receiving an operation command into a frame mode, the controller 170 may control the display 180 in the partial view mode.

The aforementioned menu mode, mood mode, music mode, frame mode, or clock mode are merely exemplary for convenience of description, and thus is not limited thereto. That is, the controller 170 may preset a mode in which the display 180 is operated, among operation modes of the display device 100, e.g., the zero view mode, the partial view mode, or the full view mode. When the operation mode of the display device 100 is a mode set to control the display 180 in the partial view mode, the controller 170 may recognize the entrance command into the partial view mode to be received.

When recognizing the entrance command into the partial view mode, the controller 170 may acquire a draw-out length of the display 180 in the partial view mode (S13), and the display 180 may be drawn out or may be retracted depending on the acquired draw-out length of the display 180 (S15).

According to an embodiment of the present disclosure, the draw-out length of the display 180 may be variable in the partial view mode. Thus, the controller 170 may acquire the draw-out length of the display 180 whenever entering the partial view mode.

According to a first embodiment, in the partial view mode, the draw-out length of the display 180 may be any one of a first length, a second length, . . . , and an $N^{th}$ length, and whenever the controller 170 enters the partial view mode, the draw-out length of the display 180 may be controlled to any one of the first length, the second length, . . . , and the $N^{th}$ length.

According to a second embodiment, in the partial view mode, a minimum draw-out length and a maximum draw-out length of the display 180 may be preset, the controller 170 may gradually increase the draw-out length of the display 180 in the case of entrance into the partial view mode compared with the draw-out length in the case of entrance into a partial view mode just before the current mode, and when the draw-out length in the case of entrance into the partial view mode just before the current mode is a maximum draw-out length, the controller 170 may gradually reduce the draw-out length of the display 180 compared with the draw-out length in the case of entrance into the partial view mode just before the current mode. Similarly, the controller 170 may gradually reduce the draw-out length of the display 180 in the case of entrance into the partial view mode compared with the partial view mode just before the current mode, and when the draw-out length in the case of entrance into the partial view mode just before the current mode is an initial draw-out length, the controller 170 may gradually increase the draw-out length of the display 180 compared with the draw-out length in the case of entrance into the partial view mode just before the current mode.

According to a third embodiment, the controller 170 may control the guide bar 184 in such a way that the draw-out length of the display 180 when entering into the partial view mode from a zero view mode in which the display 180 is entirely retracted into the housing 183 is different from the draw-out length of the display 180 when entering into the partial view mode from a full view mode in which the display 180 is drawn out from the housing 183 to the maximum.

According to a fourth embodiment, the controller 170 may randomly determine the draw-out length of the display when entering into the partial view mode within a predetermined range.

As such, the controller 170 may adjust the draw-out length of the display 180 using various methods whenever entering the partial view mode.

The controller 170 may acquire the draw-out length of the display 180 to change the draw-out length of the display 180 every time entering the partial view mode, and may control the guide bar 184 depending on the acquired draw-out length of the display 180.

The controller 170 may control the guide bar 184 to draw out the display 180 according to the draw-out length of the display 180 when converting into the partial view mode from the zero view mode and to retract the display 180 according to the draw-out length of the display 180 when converting into the partial view mode from the full view mode.

Figure 13:
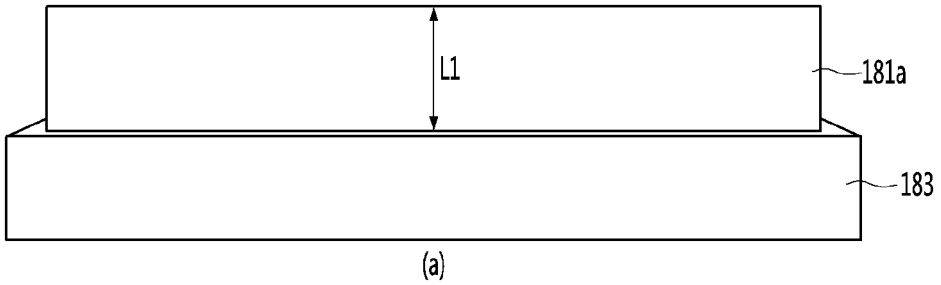
FIG. 13 is a view illustrating an example of a method of adjusting a draw-out length of a display in a partial view mode by a display device according to an embodiment of the present disclosure.
Figure 13:
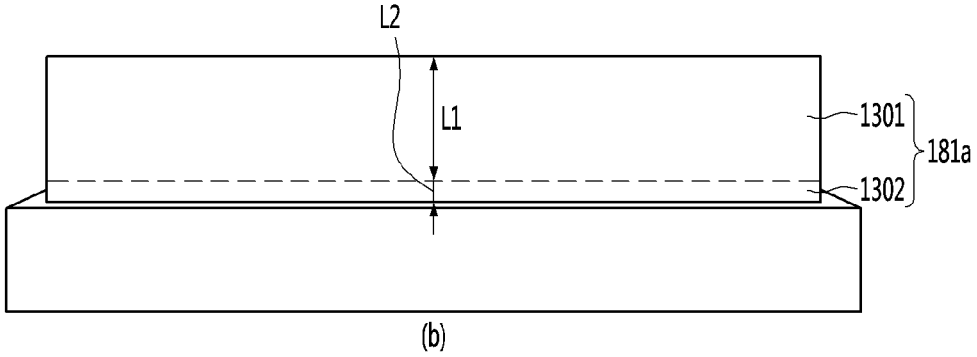

FIG. 13 is a view illustrating an example of a method of adjusting a draw-out length of a display in a partial view mode by a display device according to an embodiment of the present disclosure.

For example, the controller 170 may control the draw-out length of the display 180 to L1 at a first time entering the partial view mode, as shown in FIG. 13A, and may control the draw-out length of the display 180 to L1+L2 at a second time entrance into the partial view mode, as shown in FIG. 13B. That is, the display 180 may be in the partial view mode in the same way at the first time and the second time, but the draw-out length of the display 180 at the second time may be larger than the draw-out length of the display 180 at the first time. In this case, the partial view mode draw-out region 181*a* at the second time may include a draw-out region 1301 and an additional region 1302 in the partial view mode at the first time.

The controller 170 may control the guide bar 184 in such a way that the draw-out length of the display 180 in the partial view mode is 20% to 35% of the draw-out length in the full view mode in which the display 180 is drawn out from the housing 183 to the maximum. However, the aforementioned range of 20% to 35% is merely exemplary but is not limited thereto.

As such, when the draw-out length of the display 180 is variable in the partial view mode, the partial view mode draw-out region 181*a* is continuously changed, and thus a boundary between the partial view mode draw-out region 181*a* and the partial view mode non-draw-out region 181*b* is also continuously changed, and accordingly, a problem in terms of an afterimage at the boundary between the partial view mode draw-out region 181*a* and the partial view mode non-draw-out region 181*b* may be advantageously reduced.

According to an embodiment, the controller 170 may adjust the draw-out length of the display 180 until entering another mode (e.g., a zero view mode or a full view mode) after entering the partial view mode. That is, the controller 170 may adjust the draw-out length of the display 180 only when entering the partial view mode, and may fix the draw-out length of the display 180 in the state in which the controller 170 enters the partial view mode.

However, according to another embodiment, when the partial view mode is maintained, the controller 170 may control the guide bar 184 to change the draw-out length of the display 180 every setting period. When the partial view mode is maintained, the controller 170 may control the guide bar 184 to change the draw-out length of the display 180. That is, when the state in which the controller 170 enters the partial view mode is maintained for a predetermined, the controller 170 may change the draw-out length of the display 180 to a level in which a user is not capable of recognizing the change.

For example, when a time, during which the display 180 is drawn out by the first length, elapses by a setting period, the controller 170 may control the guide bar 184 to draw out the display 180 by the second length.

When the draw-out length of the display 180 is changed, the controller 170 may change a region, in which content is displayed, depending on the draw-out length of the display 180.

For example, when the draw-out length of the display 180 is changed every setting period, the controller 170 may control the display 180 to change a layout of content. Whenever the draw-out length of the display is changed, the controller 170 may control the display 180 so that the region in which content is displayed is an entire draw-out region of the display 180.

Again, FIG. 12 is described.

The controller 170 may acquire the region in which content is displayed depending on the draw-out length of the display 180 (S17).

When an entire region of the display 180 is the region in which content is displayed, the controller 170 may acquire a region of the display 180, in which content is displayed, depending on the draw-out length of the display 180.

For example, the controller 170 may control the draw-out length of the display 180 to the first length at the first time entering the partial view mode to the first length and may control the draw-out length of the display 180 to the second length at the second time entering the partial view mode, and in this case, the controller 170 may control the display 180 to display content in the first region of the display 180 that is drawn out by the first length at the first time and to display content in the second region of the display 180 that is drawn out by the second length at the second time.

According to a first embodiment, the controller 170 may control the display 180 to change the draw-out length of the region in which content is displayed when the draw-out length of the display 180 is changed. That is, when the draw-out length of the display 180 is changed, the controller 170 may set the display content of content depending on the draw-out length of the display 180 and then may fix the region in which content is displayed until the draw-out length of the display 180 is re-changed.

According to a second embodiment, the controller 170 may fix a size of a region in which content is displayed, irrespective of the draw-out length of the display 180, and may move the region in which content is displayed and the size of which is fixed within the region of the display, which is drawn out. That is, the controller 170 may perform control to fix a size of the region in which content is displayed and may perform control to change a position of content within the draw-out region of the display 180, which is changed whenever entering the partial view mode, thereby minimizing the possibility that an afterimage is formed.

According to a third embodiment, when the partial view mode is maintained for a predetermined time or greater, the controller 170 may control the display 180 to change the display region of content from the draw-out region of the display 180 every setting period. That is, when the draw-out length of the display 180 is maintained for a predetermined time or greater in the partial view mode, the controller 170 may change the display region of content irrespective of whether the draw-out length of the display 180 is re-changed.

Figure 14:
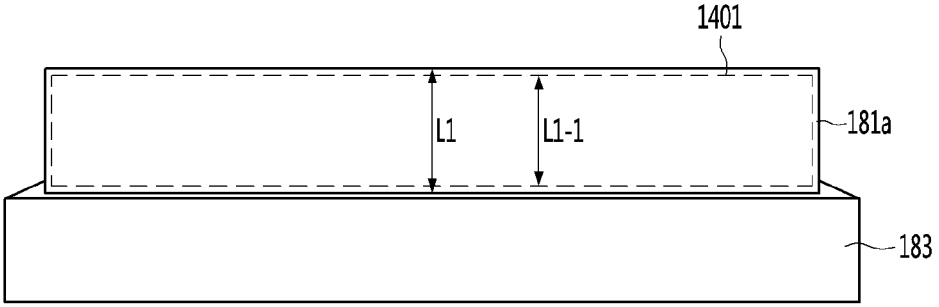
FIG. 14 is a view illustrating an example of a method of adjusting a display region of content in a partial view mode draw-out region by a display device according to an embodiment of the present disclosure.
Figure 14:
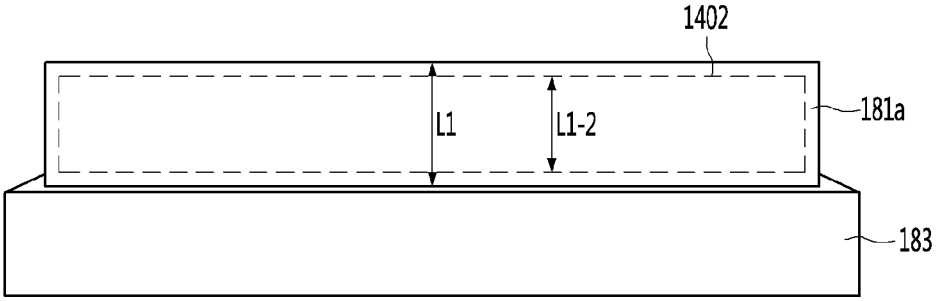

FIG. 14 is a view illustrating an example of a method of adjusting a display region of content in a partial view mode draw-out region by a display device according to an embodiment of the present disclosure.

For example, the controller 170 may control the draw-out length of the display 180 to L1 at a time entering the partial view mode and may make the display 180 be drawn out by a length corresponding to L1. In this case, the controller 170 may acquire a first region 1401 with a length L1-1 shorter than L1 as the display region of content and may control the display 180 to display content in the first region 1401.

When the partial view mode in which the draw-out length of the display 180 is controlled to L1 is maintained for a predetermined time or grater, the possibility that the display region of content is degraded may be increased, and thus the possibility that an afterimage is formed at a boundary between the display region of content and the remaining region may be increased.

Thus, when the partial view mode in which the draw-out length of the display 180 is controlled to L1 is maintained for a predetermined time that exceeds a setting period, the controller 170 may change the display region of content to a second region 1402 with a length L1-2 instead of the first region 1401. That is, the partial view mode draw-out region 181*a* may be fixed, but when the fixed state of the partial view mode draw-out region 181*a* is maintained for a predetermined time or greater, the display content of content may be changed every setting period, and thus the possibility that an afterimage is formed at a boundary between the display region of content and the remaining region may be reduced.

Again, FIG. 12 is described.

The controller 170 may acquire whether an operation mode corresponds to a preset mode (S19).

According to the first embodiment, when controlling the display 180 in the partial view mode, the controller 170 may control content as described below in S23, S25, and S27 only when the operation mode is a preset mode (e.g., a frame mode), and thus the possibility that an afterimage is formed in the partial view mode draw-out region 181*a* may be further reduced.

According to the second embodiment, when controlling the display 180 in the partial view mode, the controller 170 may control content as described below in S23, S25, and S27 irrespective of the operation mode only when the display 180 is controlled in the partial view mode, and thus the possibility that an afterimage is formed may be further reduced.

According to the third embodiment, when the display 180 is controlled in the partial view mode, content may be simply displayed according to the operation mode, but content control for reducing the possibility that an afterimage is formed may not be separately performed. That is, according to the third embodiment, when the display 180 is controlled in the partial view mode, content control described below in S23, S25, and S27 may not be performed, but content may also be displayed according to the operation mode.

Hereinafter, according to the first embodiment, a method of controlling content in order to further reduce the possibility that an afterimage is formed only when the operation mode is a preset mode (e.g., a frame mode) will be described.

In order to further reduce the possibility that an afterimage is formed, the controller 170 may preset an operation mode of separately controlling content. The controller 170 may also set the operation mode of separately controlling content upon receiving a user input.

When the operation mode does not correspond to the preset mode, the controller 170 may display control according to a layout determined for each operation mode (S21).

For example, when a menu mode, a mood mode, or the like does not correspond to the preset mode, the controller 170 may display content according to a layout corresponding to a menu mode in the menu mode, and may display content according to a layout corresponding to a mood mode in the mood mode.

When the operation mode corresponds to a preset mode, the controller 170 may roll an image set in a horizontal direction and may vary a position thereof in a vertical direction (S23).

That is, when the operation mode corresponds to a preset mode, the controller 170 may dispose an image set according to a layout, may move the image set in a horizontal direction, and may display content while varying a position thereof in a vertical direction.

Figure 15:
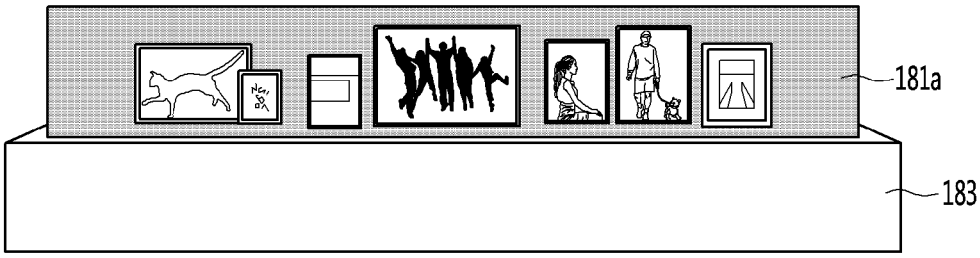
FIG. 15 is a view illustrating an example of a method of display content according to a layout by a display device according to an embodiment of the present disclosure.
Figure 16:
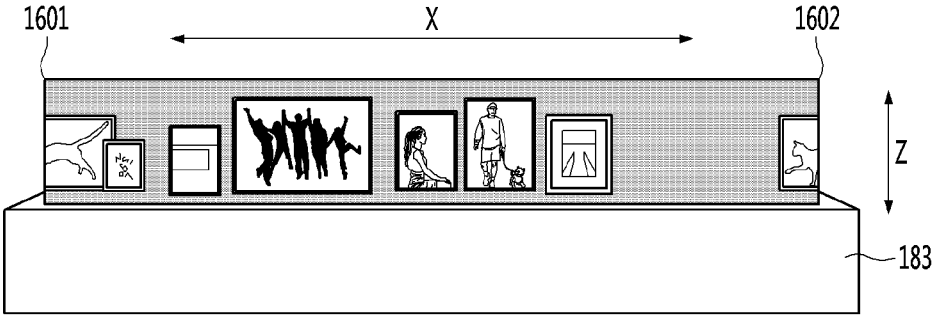
FIG. 16 is a view illustrating an example of a method of moving and displaying an image set disposed according to a layout by a display device according to an embodiment of the present disclosure.

FIG. 15 is a view illustrating an example of a method of display content according to a layout by a display device according to an embodiment of the present disclosure. FIG. 16 is a view illustrating an example of a method of moving and displaying an image set disposed according to a layout by a display device according to an embodiment of the present disclosure.

In FIGS. 15 and 16, for convenience of description, the operation mode is assumed to be a frame mode, but this is merely exemplary and thus the present disclosure is not limited thereto.

When the frame mode is not a preset operation mode, the controller 170 may display content according to a layout of the frame mode, as shown in FIG. 15. That is, the controller 170 may control the display 180 to display an image set according to a layout and to fixedly display the image set.

When the frame mode is the preset operation mode, the controller 170 may control the display 180 to dispose an image set according to a layout of the frame mode, to move the image set in a horizontal direction X as shown in FIG. 16, and to vary and display a position in a vertical direction Z.

For example, assuming that a direction of a left end 1601 of the display 180 in the horizontal direction X is a first direction and that a direction of a right end 1602 of the display 180 in the horizontal direction X is a second direction, the controller 170 may control the display 180 to move an image set in the first direction, to re-display the image set, which disappears in the first direction, in a second direction, and to change a position (a height in a vertical direction) of the image set when the image set is displayed in the second direction. Alternatively, the controller 170 may also change a height in a vertical direction by moving and displaying an image at a period corresponding to a predetermined time similarly to a horizontal direction.

When varying the position in the vertical direction of the image set, the controller 170 may process an image to fade out and fade in, thereby advantageously reducing repulsion that a user experiences when watching content.

That is, the controller 170 may determine an arbitrary position in the vertical direction Z while controlling the image set to flow in the horizontal direction X, and thus when the image set is fixed, the possibility that an afterimage is formed may be reduced. As such, when the image set is moved, degradation in image quality for reducing the possibility that an afterimage is formed may not be required, and an interruption when a user watches content may be minimized.

Figure 17:
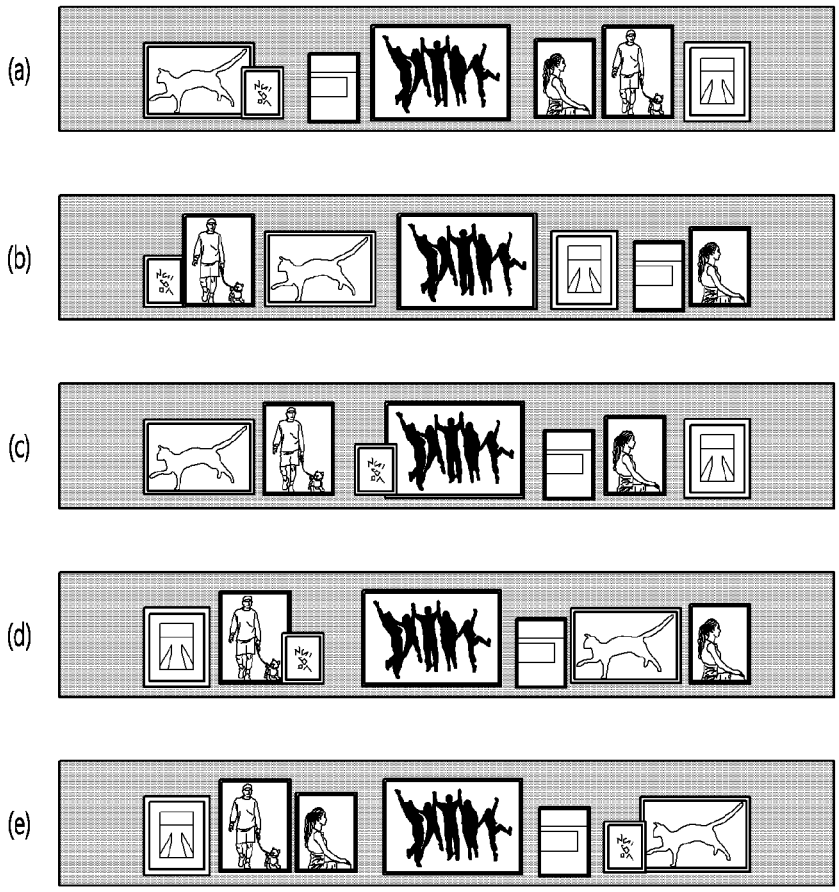
FIG. 17 is a view illustrating an example of layouts provided in a frame mode by a display device according to an embodiment of the present disclosure.

As shown in FIGS. 15 to 17, the controller 170 may control the display 180 to display a background of a region, in which an image is displayed, to be black in the frame mode. Alternatively, the controller 170 may control the display 180 to display a background to be dark to prevent a boundary of afterimages in the frame mode from being formed while a lifespan is ensured. In this case, the possibility that an afterimage is formed due to background color may be reduced, and a boundary between a display region of an image and a non-display region may be ambiguous and the possibility that an afterimage is formed at the boundary may be advantageously reduced.

The controller 170 may move the image set in horizontal and vertical directions to determine whether a displayed time elapses by a setting time (S25).

When the controller 170 moves the image set in the horizontal and vertical directions to determine that the displayed time elapses by the setting time, the controller 170 may change a layout of content (S27).

The controller 170 may change the layout of content, may then rearrange an image set according to the changed layout, may roll the rearranged image set in a horizontal direction, and may control the display 180 to vary a position a vertical direction.

FIG. 17 is a view illustrating an example of layouts provided in a frame mode by a display device according to an embodiment of the present disclosure.

The controller 170 may change the layout of content between first and fifth layouts shown in FIG. 17 every setting time, and in this case, the possibility that an after image is formed may be reduced.

In particular, when an image set is moved along a predetermined track, the possibility that an afterimage is formed along the predetermined track may be increased, but pixels with high possibility that an afterimage is formed may be advantageously dispersed by changing the layout of content every setting time and by varying a position in horizontal and vertical directions.

Although five layouts are illustrated in the example of FIG. 17, the number of layouts and the type thereof are not limited to FIG. 17 but may be further diversified.

Differently from the above description, the controller 170 may also control the display 180 to change the display region of content whenever entering the partial view mode. That is, the controller 170 may fix the draw-out length of the display 180 whenever entering the partial view mode and may also change a region in which content is displayed within a draw-out region.

The controller 170 may also perform control to change both the draw-out length of the display 180 and the display region of content whenever entering the partial view mode.

According to the present embodiment, a problem in terms of an afterimage in a rollable display may be advantageously overcome.

In particular, the possibility that an afterimage is formed in a display device for supporting a mode in which content is displayed only in a partial region of a display like in a partial view mode may be advantageously reduced.

In addition, a problem in terms of an afterimage may be overcome at a level that is difficult to be recognized by a user, and thus an interruption when the user watches content may be advantageously minimized.

Each of the embodiments disclosed in the present specification may be executed alone or in combination with other embodiments.

The above description is merely illustrative of the technical idea of the present disclosure, and various modifications and changes may be made thereto by those skilled in the art without departing from the essential characteristics of the present disclosure.

Therefore, the embodiments of the present disclosure are not intended to limit the technical spirit of the present disclosure but to illustrate the technical idea of the present disclosure, and the technical spirit of the present disclosure is not limited by these embodiments.

The scope of protection of the present disclosure should be interpreted by the appending claims, and all technical ideas within the scope of equivalents should be construed as falling within the scope of the present disclosure.

What is claimed is:

1. A display device comprising:

a housing;

a display;

a roller disposed inside the housing, wherein the roller is configured to rotate in a first direction for the display to be wound around the roller or in a second direction for the display to be unwound around the roller; and a controller configured to:

cause the display to display content in a region of the display that is extended to a first length from the housing when in a partial view mode, wherein an extended length of the display to be extended from the housing is variable, wherein the partial view mode is entered in response to receiving a command activating a frame mode, and cause the display to display a black background in the region of the display when in the frame mode.

2. The display device of claim 1, wherein the controller is configured to control the roller to change the extended length of the display when entering the partial view mode.

3. The display device of claim 2, wherein the controller is configured to control the roller to change the extended length of the display to a first length when entering the partial view mode at a first time and to control the extended length of the display to a second length when entering the partial view mode at a second time, wherein the first time occurs before the second time.

4. The display device of claim 3, wherein the controller is configured to cause the display to display the content in a first portion of the region of the display corresponding to the first length at the first time and to cause the display to display the content in a second portion of the region of the display corresponding to the second length at the second time.

5. The display device of claim 1, wherein the controller is configured to control the roller to periodically rotate to change the extended length of the display when in the partial view mode.

6. The display device of claim 5, wherein the controller is configured to control the roller to rotate to change the extended length of the display to a second length when the display has been drawn out to the first length for a time period.

7. The display device of claim 6, wherein the controller is configured to change the region in which the content is displayed when the extended length of the display changes.

8. The display device of claim 5, wherein the controller is configured to change a layout of the content on the display when the extended length of the display changes.

9. The display device of claim 5, wherein the region in which the content is displayed corresponds to an entire extended region of the display when the extended length changes.

10. The display device of claim 1, wherein the controller is configured to change a size of the region depending on the extended length when the extended length of the display changes.

11. The display device of claim 1, wherein the controller is configured, in the frame mode, to control the display to:

move a set of images in a first direction, re-display at least a portion of the set of images to be displayed in a second direction that is opposite to the first direction, wherein at least a portion of an image from the set of images is no longer displayed due to moving the set of images to be displayed in the first direction, and change a position of the set of images after the re-displayed set of images is to be displayed in the second direction.

12. The display device of claim 1, wherein the controller is configured to control the display to change the region in which content is displayed to a different region of the display that is drawn out from the housing after the partial view mode has been entered for a predetermined time period.

13. The display device of claim 1, wherein the controller is configured to control the display to change the region in which content is displayed to a different region of the display that is drawn out from the housing when entering the partial view mode.

14. The display device of claim 1, wherein the controller is configured to control the roller to rotate in the first direction or the second direction such that the extended length of the display in the partial view mode is 20% to 35% of an extended length in a full view mode, wherein the full view mode draws out the display to a maximum length from the housing.

15. The display device of claim 1, wherein the controller is configured to randomly determine the extended length of the display within a predetermined range when entering the partial view mode.

16. The display device of claim 1, wherein the controller is configured to control the roller to rotate in the first direction or the second direction such that the extended length of the display when entering the partial view mode from a zero view mode is different from the extended length of the display when entering the partial view mode from a full view mode, wherein the zero view mode retracts the display entirely into the housing, wherein the full view mode draws out the display to a maximum length from the housing.

17. The display device of claim 1, wherein the controller is configured to fix a size of the region in which the content is displayed, wherein the fixed size of the region is independent from the extended length of the display.

18. The display device of claim 17, wherein the controller is configured to move the region in which the content is displayed within a section where the display is drawn out from the housing.

* * * * *